United States Patent [19]

Fischer

[11] Patent Number: 4,660,633

[45] Date of Patent: Apr. 28, 1987

[54] PLATE HEAT EXCHANGER

[76] Inventor: Helmut Fischer, Kuniglberggasse 5, A-1130 Wien, Austria

[21] Appl. No.: 735,573

[22] Filed: May 20, 1985

[51] Int. Cl.[4] ..... F28F 3/10

[52] U.S. Cl. ..... 165/167

[58] Field of Search ..... 165/167

[56] References Cited

U.S. PATENT DOCUMENTS 4,063,591 12/1977 Usher ..... 165/167

4,146,090 3/1979 Nakayama et al. ..... 165/167 X

*Primary Examiner*—Allen M. Ostrager

*Attorney, Agent, or Firm*—Lackenbach Siegel Marzullo & Aronson

[57] ABSTRACT

A plate heat exchanger where a number of heat exchange plates of two different types are clamped between two massive pressure plates. The heat exchanger plates are provided with a first flow zone surrounded by an edge seal having first passage openings for a first fluid medium. The heat exchanger plates are further provided with a second flow zone having second passage openings surrounded by an annular seal for a second fluid medium outside of the first flow zone. The annular seal is embedded in a first reinforcing seam having a bottom wall and upwardly and outwardly tapering side walls. The heat exchanger plates further include a bottom plate adjoining the annular seal and which is provided with a second reinforcing seam disposed parallel and below the first reinforcing seam and which broadens in an upward direction. The second reinforcing seam is provided with a plurality of supporting bulges extending into and narrowing the second reinforcing seam. The supporting bulges are in contact with the bottom wall of the first reinforcing seam. The first flow zone is in part defined by the bottom plate and the bottom wall of the first reinforcing seam. The first fluid medium flows under the annular seal and simultaneously between the supporting bulges. A second seal spaced from the annular seal having the same characteristics as the annular seal is preferably provided.

4 Claims, 6 Drawing Figures

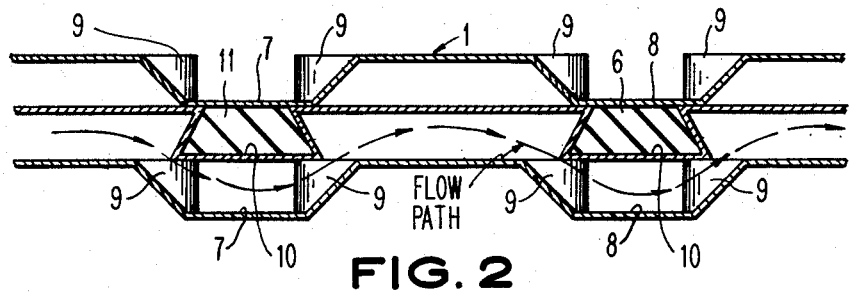
FIG. 2
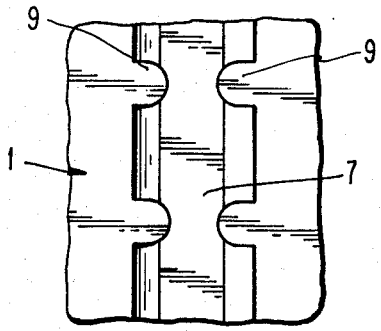
FIG. 3
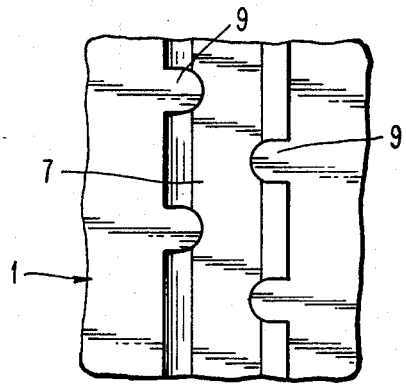
FIG. 4
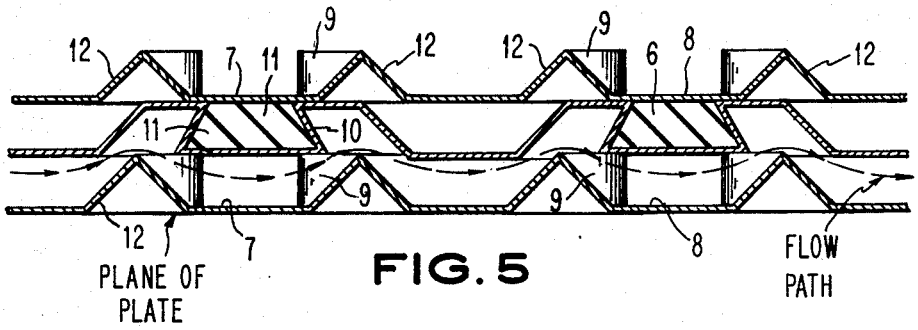
FIG. 5
FIG. 6
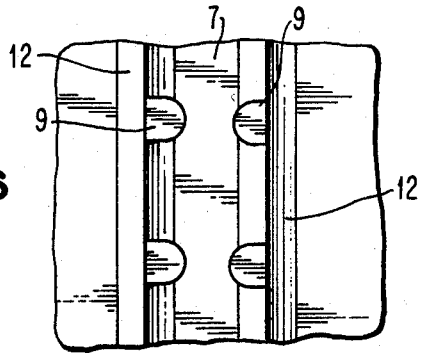

PLATE HEAT EXCHANGER

The invention relates to a demountable plate heat exchanger which comprises a stack of successively following heat exchanger plates, which are preferably stamped from sheet metal, where on the one hand a flow zone is provided surrounded by an edge seal and where on the other hand, in addition, passage openings are provided for the two media, where in each case the flow space for the first medium encloses also the passage openings for this medium; whereas the passage openings for the second medium are disposed outside of this flow space and are enclosed by seals such that the two media are separated from each other by double seals.

In the case of the joining plate, the space disposed below the double seals belongs to the flow space for the second medium. It is an object of the invention to provide an embodiment which is particularly stiff in retaining its form as it relates to the region particularly critical for the pressure stability of the heat exchanger.

The seals of the heat exchanger plates are disposed embedded in grooves in order to prevent a sideways escaping of the seals and in order to achieve the surface area pressing required for higher operating pressures. In general, the seals are produced of elastic materials. It is relatively simple in the area of the plate edge to achieve the required pressing since here sheet metal and a seal are disposed on top of each other in an alternating sequence, and since the compression pressures are fully transmitted from one plate to the next.

However, in those zones where the passage opening is connected to the flow zone, the seal of the neighboring plates presses onto a hollow disposed location, whereby the danger of bending is generated. Since heat exchanger plates are to be produced from sheet metal as thin as possible, one attempts to prevent a bending in this region by a particular form embodiment of the plate. The following provisions are to be counted as such steps. Support knobs are applied along the sealing groove in order to maintain the distance between the plates. This construction in fact provides an improvement; however, it is only effective to a limited extent. Even though the sealing reinforcing seam, formed in general like a U-shape and provided for receiving the seal, has due to its shape a substantial stiffness, nevertheless between the sealing reinforcing seam and the neighboring support knobs there is a bending through, which frequently results in leaks, both in the elastic region as well as upon occurrence of permanent deformations. Therefore, it has been attempted to substitute the support knobs by stamped out areas running substantially perpendicular to the sealing reinforcing seam and running into the sealing enforcing seams. This in fact provides an improved force transmission from the support location to the reinforcing seam bead; however, it weakens the reinforcing seam itself, which is interrupted at the position of joining to the pressed out area. This interruption in addition allows for the seal to escape at this position on the side, which is disadvantageous in view of the required face pressing of the seal.

In order to avoid the above described disadvantages, the step has been taken with heat exchanger plates, which are to be employed for high operating pressures, of welding a support element in the flow space of the plates below the sealing groove of the neighboring plate. This space filling element, or shim, furnishes wave-shaped, corrugated bend sheet metal strips, which have approximately the width of the seal and which are disposed below the sealing reinforcing seam and are welded to the neighboring plate. This embodiment not only entails the disadvantage of substantially higher production costs, but in addition provides a factor of insecurity because of numerous welding locations. Larger heat exchanger plates of this kind frequently have more than a hundred such weld points, which can result in an interference of the metal base construction.

In accordance with the subject of the invention, heat exchanger plates of pure impressed or stamped construction are employed, which fully meet the requirements as to pressure stability based on a particular form provision of the sealing groove in the region of the passage openings and of the flow space of neighboring plates. The sealing groove of the passage opening is provided such that it narrows down toward the top. A trapezoidal rubber seal is embedded therein. The smaller side of the rubber seal is upwardly directed. The neighboring plate below the sealing reinforcing seam is also provided with a reinforcing seam, which however opens in an upward direction. In this way, the free slot required between the neighboring plates is provided. The edges of this reinforcing seam are provided with several inwardly turned bulges which are dimensioned so that they contact the adjoining plate in the region of the edges of the sealing reinforcing seam or slightly within these edges. In this way, the sealing reinforcing seam is directly supported.

In analogy to this, in addition, each part section of the boundary of the flow space is provided, which flow space is directed toward the passage opening. The provision of the other edge reinforcing seams and their seals are not the subject matter of the present invention.

FIG. 1 shows a heat exchanger plate according to the invention in plan view, FIG. 2 shows a section through a sealing section of three plates disposed successively on top of each other in the region of the passage openings, FIG. 3 illustrates a section of the uppermost of the three plates in a plan view, FIG. 4 is a view of a section like that of FIG. 3 with staggeredly disposed supporting elements, FIG. 5 shows a section which is a variant relative to the section shown in FIG. 2, and FIG. 6 illustrates a section of the uppermost of the three plates in a plan view.

FIG. 1 illustrates a heat exchanger plate with the flow zone 1, with the passage openings 2 disposed within this zone and the passage openings 3 disposed outside of the flow zone. The flow zone 1 is surrounded by a seal 4, the section 5 of which together with the seal 11 embedded therein form part of a double seal versus the passage openings 3, which in turn are surrounded by a seal 6. A reinforcing seam 7 is provided relative to the sealing section 5 and symmetrically with respect to the longitudinal axis of the plate. A reinforcing seam 8 is provided symmetrically to the part section of the seal 6 directed toward the flow zone. The two reinforcing seams 7 and 8 are provided with bulges 9.

FIG. 2 shows a section through a reinforcing seam of three plates disposed on top of each along the line AB. The middle plate of the three is provided with reinforcing seams 10 which narrow conically in upward direction for the reception of the seals 6 and 11. The bulges 9 of the neighboring plate are supported at the bottom side of the reinforcing seams 10.

FIG. 3 shows a part section of the reinforcing seam 7 in plan view, where the bulges 9 are disposed oppositely to each other.

FIG. 4 shows such a section as a variant where the bulges 9 are disposed staggered with respect to each other.

Figure 1:
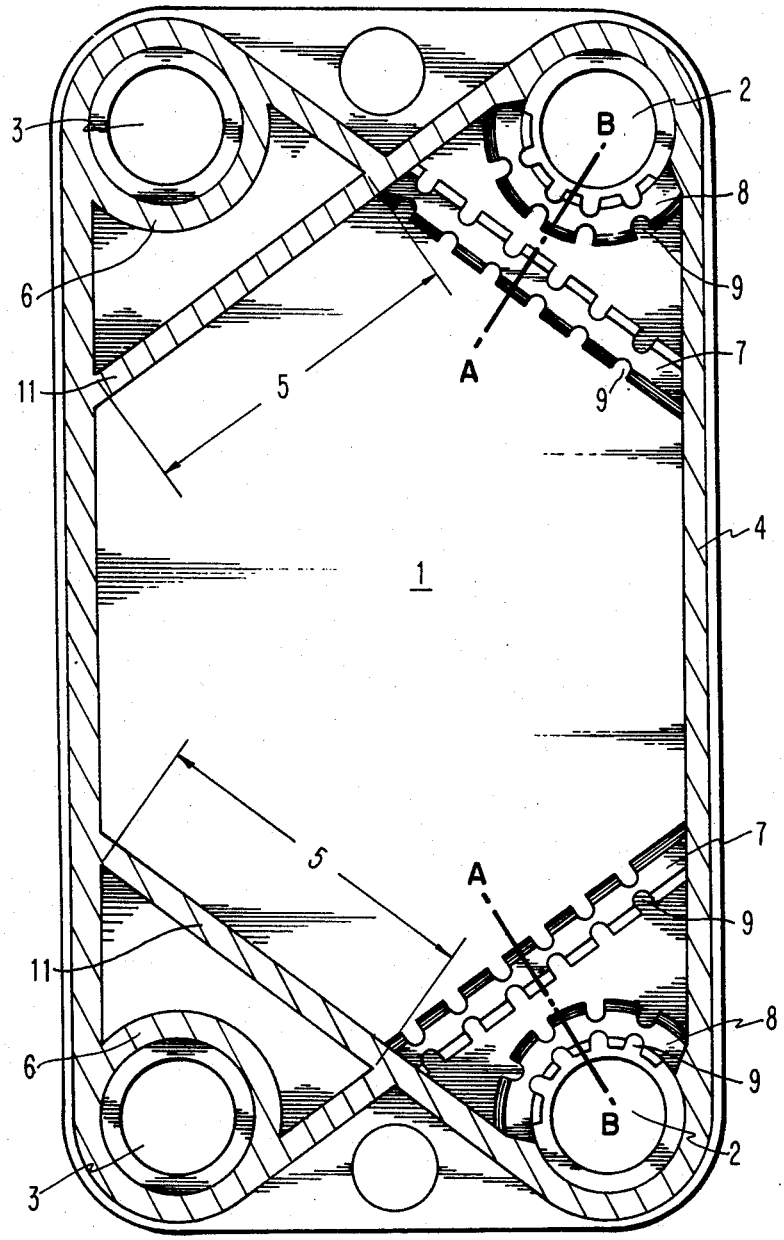

FIG. 5 shows a section through a sealing section of three plates disposed on top of each other as further embodiment. The reinforcing seams 7 and 8 are in this case formed by two roof-shaped protrusions 12, into which the bulges 9 are integrated.

FIG. 6 shows a plan view of a part section of the reinforcing seam 7, which is formed by the the protrusions 12 as well as the bulges 9 integrated therein.

What is claimed is:

1. A plate heat exchanger where a number of heat exchange plates of two different types are clamped between two massive pressure plates, said heat exchanger plates being provided with a first flow zone surrounded by an edge seal having first passage openings for a first fluid medium, said heat exchanger plates being further provided with a second flow zone having second passage openings surrounded by an annular seal for a second fluid medium outside of said first flow zone, said annular seal being embedded in a first reinforcing seam having a bottom wall and upwardly and outwardly tapering side walls, said heat exchanger plates further including a bottom plate adjoining said annular seal and which is provided with a second reinforcing seam disposed parallel and below said first reinforcing seam and which broadens in an upward direction, said second reinforcing seam being provided with a plurality of supporting bulges extending into and narrowing said second reinforcing seam, said supporting bulges being in contact with said bottom wall of said first reinforcing seam, said first flow zone being in part defined by said bottom plate and said bottom wall of said first reinforcing seam, said first fluid medium flowing under said annular seal and simultaneously between said supporting bulges.

2. A plate heat exchanger according to claim 1, further including a third seal spaced from said annular seal for said second fluid medium embedded in a third reinforcing seam having a bottom wall and upwardly and outwardly tapering side walls, said bottom plate adjoining said third seal which is provided with a fourth reinforcing seam disposed parallel and below said third reinforcing seam and which broadens in an upward direction, said third reinforcing seam being provided with a plurality of other supporting bulges extending into and narrowing said fourth reinforcing seam, said other supporting bulges being in contact with said bottom wall of said first reinforcing seam, said first flow zone being in part defined by said bottom plate and said bottom wall of said third reinforcing seam, said first fluid medium flowing under said second seal and simultaneously between said supporting bulges.

3. The plate heat exchanger according to claim 1, wherein said first and third reinforcing seams are each formed by by two parallel V-shaped reinforcing seams protruding upwardly from the plane of said bottom plate and by strip-like portions disposed in said plate connecting said V-shaped reinforcing seams.

4. The plate heat exchanger according to claim 2, wherein said bulges and said other bulges are disposed staggered with respect to each other.

* * * * *